United States Patent [19]

Pries

[11] 4,113,570

[45] Sep. 12, 1978

[54] RICH-GAS BURNER ARRANGEMENT IN HEATING FLUES FOR COKE OVEN CHAMBERS

[75] Inventor: Erich Pries, Bochum, Fed. Rep. of Germany

[73] Assignee: Dr. C. Otto & Comp. G.m.b.H., Bochum, Fed. Rep. of Germany

[21] Appl. No.: 747,381

[22] Filed: Dec. 3, 1976

[30] Foreign Application Priority Data

Dec. 18, 1975 [DE] Fed. Rep. of Germany ..... 2557084

[51] Int. Cl.[2] ..... C10B 5/02

[52] U.S. Cl. ..... 202/139; 202/141; 202/142; 202/143; 202/144; 202/151

[58] Field of Search ..... 202/125, 135, 139–144, 202/221, 220, 151, 126; 201/26

[56] References Cited

U.S. PATENT DOCUMENTS

| | | | |
|---|---|---|---|
| 2,100,762 | 11/1937 | Becker | 202/143 |
| 2,220,919 | 10/1940 | Staeckel | 202/144 |
| 2,839,453 | 6/1958 | Becker | 202/139 |
| 4,004,983 | 1/1977 | Pries | 202/142 |

FOREIGN PATENT DOCUMENTS

| | | | |
|---|---|---|---|
| 18,034 | 2/1926 | Netherlands | 202/151 |
| 165,765 | 12/1933 | Switzerland | 202/139 |

*Primary Examiner*—Morris O. Wolk
*Assistant Examiner*—Michael S. Marcus
*Attorney, Agent, or Firm*—Thomas H. Murray

[57] ABSTRACT

Vertical heating flues between adjacent coke oven chambers include rich-gas burners extending essentially to progressively increasing elevations in the flues in a manner such that the burner exit zones increase from flue-to-flue to a maximum elevation at the pusher side of each oven chamber. At the pusher side, the coke oven chamber has a minimum width which increases to a maximum width at the coke side where the rich-gas burners have exit zones at the lowest elevation in the heating flues. Such a rich-gas burner arrangement may additionally include rich-gas burners with exit zones at the soles of alternate heating flues while the remaining heating flues contain the burners extended to progressively increasing elevations. When the coke oven chambers are heated by twin-heating flues, the rich-gas burners extend vertically from the soles of only one heating flue in each of the twin-heating flues.

3 Claims, 2 Drawing Figures

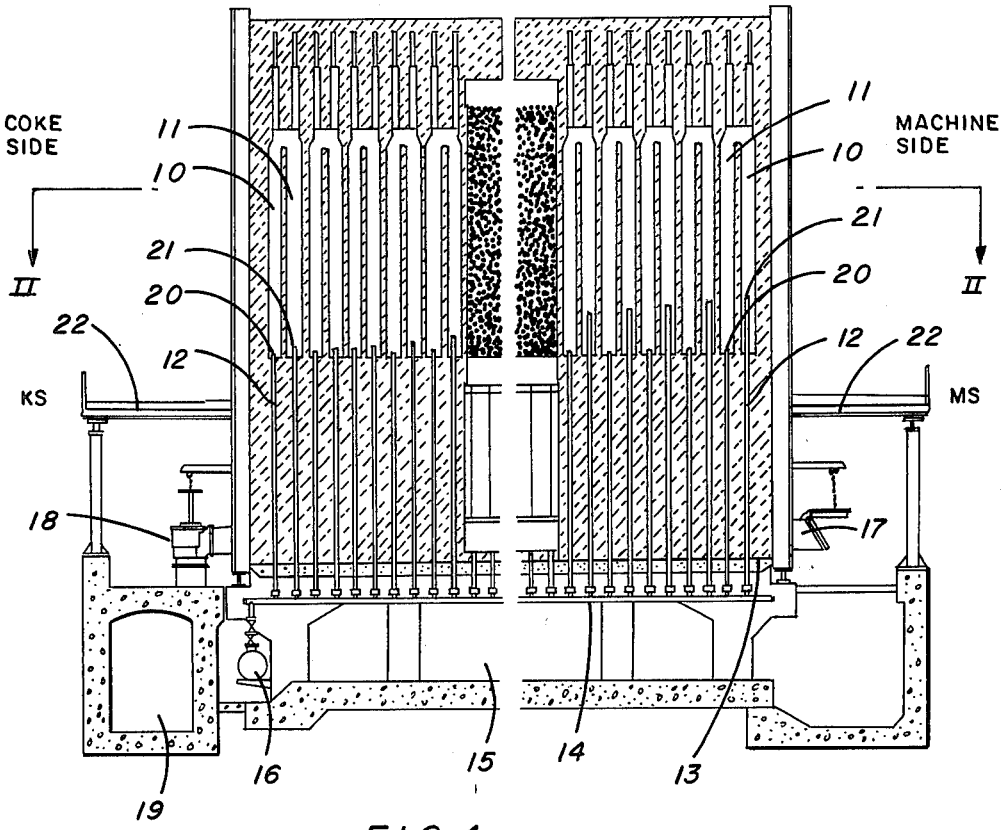
FIG. 1
FIG. 2
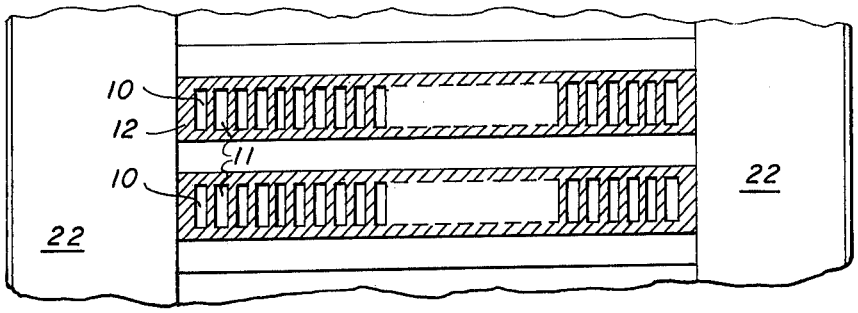

RICH-GAS BURNER ARRANGEMENT IN HEATING FLUES FOR COKE OVEN CHAMBERS

BACKGROUND OF THE INVENTION

This invention relates to a battery of coke oven chambers which is constructed and arranged so that the width of each coking chamber decreases from the coking side toward the pusher side while the space between adjacent heating walls is subdivided into vertical heating flues wherein rich-gas burners extend from the soles of the heating flues. More particularly, the present invention is addressed to a novel arrangement of such rich-gas burners which extend to progressively increasing elevations from burner-to-burner to a maximum elevation at the pusher side of the coke oven chambers.

The shape, and more particularly, the height of the flame from rich-gas burners in heating flues is determined by the height at which the rich gas is discharged from the top exit zone of the burner. Other factors determining this height include the speed at which the gas leaves the exit zone of the burners and the upward thrust of the regeneratively preheated combustion-supporting air supplied at the sole of the heating flues. Uniform heating of the coking coal contents in adjacent coking chambers depends upon the shape, and more particularly the height, of the rich-gas flame in the heating flues.

As a rule, the width of a coke oven chamber decreases from the coke side toward the pusher side to facilitate pushing out the carbonized coke. For example, the width of a coking chamber may decrease from 480 millimeters at the coking side to 420 millimeters at the pusher side. This corresponds to approximately a 15% increase to the volume of coking coal at the coking side as compared with the pusher side. The heat consumption by the coking coal is correspondingly increased. The heating flues at the coking side, therefore, receive a much greater quantity of gas than the quantity of gas which is fed into the heating flues at the pusher side. All other conditions being equal, the resulting rich-gas flame is shorter in proportion as the quantity of gas becomes smaller and the shorter flame alters the vertical distribution of heat transferred from the heating flues to the coking coal in the oven chamber.

SUMMARY OF THE INVENTION

It is an object of the present invention to insure uniform heating of the contents in a coking chamber by overcoming the aforementioned disadvantages in a manner which provides that the height of the exit zones of rich-gas burners increases from flue-to-flue from the coke side toward the pusher side to vary heat distribution lengthwise of the coking chamber and provide uniform heating of the coking coal in the chamber.

It is another object of the present invention to provide that the height of rich-gas burners, at least in part of the heating flues for adjacent coke oven chambers, increases to such an extent from the coke side toward the pusher side that the top end of the flame from the burners is at substantially the same height in all the heating flues for the adjacent coke oven chambers.

A realization of these objects provides features and advantages of the present invention that insure uniform heating to the coking coal in oven chambers. To insure adequate heating in the bottom region of the oven chambers, heating flues having rich-gas exit zones near or at the sole of the heating flues can alternate along the length of the heating walls with heating flues wherein the height of the rich-gas burners increases with respect to their exit zones from the coke side toward the pusher side. In the event the heat flues between heating walls are divided into a twin-pair of heating flues, the height of the exit zones of the rich-gas burners increases from the coke side toward the pusher side in one flue of each twin-pair of heating flues; whereas the height of the rich-gas burners in the remaining flue of each twin-pair of heating flues remains the same over the length of the oven chamber.

In accordance with the present invention, there is provided in a battery of coke ovens including coke oven chambers which decrease in width along their length from the coke side to the pusher side of the coke ovens, the coke oven chambers including individual heating walls and vertical heating flues formed by flue walls arranged to subdivide the space between heating walls of adjacent coke even chambers, the combination therewith comprising rich-gas burners extending vertically from the soles along vertical heating flues to progressively increasing elevations so that the elevations of the exit zones increase from burner-to-burner in heating flues between the heating walls for adjacent coke oven chambers, the rich-gas burners extending to the greatest elevational height at the pusher side each coke oven chamber for optimum heating consumption by the decreasing width to the charge of coking coal to provide uniform heating thereof within the coke oven chamber.

These features and advantages of the present invention as well as others will be more fully understood when the following description is read in light of the accompanying drawing wherein FIG. 1 is an elevational view, in section, through a heating wall of a battery of horizontal coke ovens with the central portion of the heating wall being broken away to a laterally-displaced plane through a coking chamber and FIG. 2 is a sectional view taken along line II—II of FIG. 1.

The heating flues shown in FIGS. 1 and 2 the drawing for the coke oven chamber are of the twin-heating flue type. Reference numeral 10 identifies odd-numbered flues of the twin-pair of heating flues and reference numeral 11 denotes the even-numbered flues thereof. Flue crosswalls subdivide the space between heating walls and thereby define the twin-heating flues. The flues are operated in alternative flow directions on a regenerative basis whereby the gases rise and fall in each single flue on the regenerative basis. Rich-gas burners 20 are disposed at the soles in the heating flues 10 and rich-gas burners 21 extend to varying elevations from the soles of heating flues 11 as will be described in greater detail hereinafter. Reference character MS denotes the pusher side and reference character KS denotes the coking side of the oven chambers in the battery of coke ovens.

Burners 20 and 21 are connected to vertical passages 12 which extend through regenerator walls 13. Rich-gas distribution lines 14 extend lengthwise of the heating wall while located in cellar 15 where they are connected to a rich-gas main 16.

Air valves 17 are connected to the regenerator sill passages and changeover valves 18 are connected to the waste-gas flues 19. A platform 22 supports a coke pusher at the machine side of the oven chambers and a platform 22 supports a coke guide and other apparatus at the coke side of the oven chambers.

As shown in the drawing, burners 21 in the even-numbered flues 11 increase in height from the coke side toward the pusher side while burners 20 in the odd-numbered heating flues 10 terminate immediately above the sole of the heating flues. Thus, it can be seen that the burners 21 extend in the heating flues 11 to progressively increasing elevations which change from burner 11-to-burner 11 to a maximum elevation at the pusher side; the burners 21 at the coke side are at the lowest elevation with respect to the sole of the heating flue.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. In a battery of coke ovens including coke oven chambers which decrease in width along their length from the coke side to the pusher side of the coke ovens, said coke oven chambers including individual heating walls and vertical heating flues formed by flue walls arranged to subdivide the space between heating walls of adjacent coke oven chambers, the combination therewith comprising rich-gas burners extending vertically from the flue soles along said vertical heating flues, said rich-gas burners being alternate flues and extending to progressively increasing elevations above the flue soles such that the rich-gas burner exit zones increase in height from burner-to-burner in heating flues between the heating walls for adjacent coke oven chambers, the flue soles within each row of heating flues being located on the same horizontal plane, said rich-gas burners extending to the greatest elevational height at the pusher side of each coke oven chamber for optimum heat consumption by a charge of coking coal through uniform heating thereof within the coke oven chambers along the decreasing width thereof.

2. The combination according to claim 1 further comprising rich-gas sole burners having exit zones on the soles of remaining heating flues.

3. The combination according to claim 1 wherein said flue walls define pairs of twin-heating flues.

* * * * *